US011333328B1

(12) United States Patent
Yang

(10) Patent No.: US 11,333,328 B1
(45) Date of Patent: May 17, 2022

(54) LAMPSHADE MODULE CAPABLE OF REPLACING OPTICAL PROJECTION ELEMENTS

(71) Applicant: SMART ELECTRIC WORKS CO., LTD., Chang Hua Hsien (TW)

(72) Inventor: Jerry Yang, Taichung (TW)

(73) Assignee: Smart Electric Works Co., Ltd., Chang Hua Hsien (TW)

( * ) Notice: Subject to any disclaimer, the term of this patent is extended or adjusted under 35 U.S.C. 154(b) by 0 days.

(21) Appl. No.: 17/220,912

(22) Filed: Apr. 1, 2021

(51) Int. Cl.

| | |
|---|---|
| ***F21V 17/06*** | (2006.01) |
| ***F21V 5/04*** | (2006.01) |
| ***F21V 5/00*** | (2018.01) |
| *F21Y 115/10* | (2016.01) |
| *F21V 7/00* | (2006.01) |

(52) U.S. Cl.
CPC ..... *F21V 17/06* (2013.01); *F21V 5/007* (2013.01); *F21V 5/04* (2013.01); *F21V 7/0083* (2013.01); *F21Y 2115/10* (2016.08)

(58) Field of Classification Search
CPC ..... F21Y 2105/10; F21V 5/007; F21V 7/0083
See application file for complete search history.

(56) References Cited

U.S. PATENT DOCUMENTS 6,402,347 B1 6/2002 Maas et al.
6,814,470 B2 11/2004 Rizkin et al.
2011/0261568 A1* 10/2011 Dalsgaard ..... F21V 21/30 362/249.03
2012/0127730 A1* 5/2012 Shih ..... F21V 19/003 362/311.02
2012/0320602 A1* 12/2012 Riesebosch ..... F21V 5/007 362/297
2013/0215611 A1* 8/2013 Wong ..... F21V 7/0083 362/243
2016/0363290 A1* 12/2016 Beiwen ..... F21S 41/321
2016/0363302 A1* 12/2016 Madril ..... F21V 5/04
2017/0003002 A1* 1/2017 Lee ..... F21V 7/0083
2017/0307148 A1* 10/2017 Sharrah ..... F21L 4/045
2017/0349088 A1* 12/2017 Yokoyama ..... F21S 43/26

* cited by examiner

*Primary Examiner* — Rajarshi Chakraborty
*Assistant Examiner* — Michael Chiang
(74) *Attorney, Agent, or Firm* — Pai Patent & Trademark Law Firm; Chao-Chang David Pai

(57) ABSTRACT

A lampshade module to be combined on a lamp to change the light projection angle of the lamp includes a lens holder having lens holes and first buckle portions at the hole wall of each lens hole for holding down the inserted lens, and a plurality of lenses each having a light entrance surface corresponding to the bottom end of one respective lens hole and an opposing light-emitting surface. The light entrance surface is a convex arc surface, and the arc of the convex arc surface is set according to the light projection angle required. In this way, the lenses with the appropriate projection angles can be selected and assembled in the lens holes, and then the lens holder can be assembled in the lamp.

19 Claims, 5 Drawing Sheets

LAMPSHADE MODULE CAPABLE OF REPLACING OPTICAL PROJECTION ELEMENTS

BACKGROUND OF THE INVENTION

(a) Field of the Invention

The present invention relates to lampshade module technology and more particularly to a lampshade module capable of replacing optical projection elements that is to be combined in front of a light-emitting module of a lamp, and has lenses fitted on a lens holder thereof corresponding to the respective light-emitting diodes of the light-emitting module to change the projection angle of the light emitted by the light-emitting module.

(b) Description of the Prior Art

LED projection light is shown in U.S. Pat. No. 6,402,347B1, which mainly comprises a light-emitting module, which has a plurality of light-emitting diodes (LEDs) in a circular array packaged on a front surface of a substrate thereof. In order to set the light projection angle, an optical lampshade is usually assembled in front of the light-emitting module. The optical lampshade mainly comprises a lens holder made of plastic integral molding. The back of the lens holder is integrally formed with a plurality of protruding lens portions. The center of each lens portion has a light entrance surface, and the light entrance surface direction faces the front light-emitting surface of the lens holder. In this way, the light-emitting diodes of the light-emitting module are respectively aligned with the light entrance surfaces of the lens portions to achieve the function of setting the light projection angle of the lamp.

However, projection lamps have different light projection angle requirements in different applications. For this reason, a variety of optical lampshades must be manufactured. The structure of the lens portions of each optical lampshade is slightly different, and then the optical lampshade with the required angle is selected and assembled in front of the light-emitting module. For example, the first projection lamp is 30°, the second projection lamp is 60°, and so on, so that consumers can choose. However, once the lamp size, shape, light-emitting module structure or the position of the light-emitting diodes is slightly changed, the mold must be reopened to manufacture the corresponding optical lampshade. This small change affects everything, causing the manufacturing cost of many optical lampshades to increase, and the sales channel has to stock many lamps of different projection angles, which will cause inventory pressure. In addition, changing the optical lampshade to a replaceable structure will also cause rainwater to seep into the assembly gap. Therefore, how to eliminate the shortcomings of the conventional optical lampshade is a subject to be actively overcome by the present invention.

Although the Highly efficient LED lamp shown in U.S. Pat. No. 6,814,470B2 has non-imaging optical elements 16 assembled in the optical module 12, the optical module 12 is provided with a plurality of holes communicating with the LED 14, so it is easy for water to penetrate into the LED 14.

SUMMARY OF THE INVENTION

The present invention has been accomplished under the circumstances in view. The main object of the present invention is to provide a lampshade module capable of replacing optical projection elements, which can easily provide a lamp with a variety of different light projection angles through the combination structure of a lens holder and a plurality of lenses and, which allows easy replacement of the lens holder or the lenses, thus reducing manufacturing costs and the inventory pressure of the sales channel, while preventing rainwater infiltration.

To achieve this and other objects of the present invention, a lampshade module capable of replacing optical projection elements is used to combine on a lamp to adjust the light projection angle of light-emitting diodes of a light-emitting module. The lampshade module comprises a lens holder and a plurality of lenses. The lens holder comprises a front surface, an opposing bottom surface, a plurality of lens holes recessed from the front surface toward the bottom surface and at least one first buckle portion located on the hole wall of each lens hole for holding down a lens inserted into the associated lens hole. Each lens hole has a back end corresponding to one respective light-emitting diode of the lamp. The lenses are respectively inserted into the lens holes of the lens holder. The lenses are light-transmitting lenses, each comprising a light entrance surface, a light-emitting surface opposite to the light entrance surface, and at least one second buckle portion formed around the periphery thereof for buckling and fixing on the at least one first buckle portion of the respective lens hole. The light entrance surface is a convex arc surface protruding in direction toward one respective light-emitting diode. The convex arc surface is used to cause the light of the respective light-emitting diode to enter and project at a light projection angle, Preferably, each lens further comprises a back end opposite to the light-emitting surface, a groove recessed from the back end in direction toward the light-emitting surface. The light entrance surface is formed at the bottom of the groove.

Preferably, the arcs of the convex arc surfaces of the lenses are different and adapted for generating different light projection angles.

Preferably, the different light projection angles are within the range 5°-12 0°.

Preferably, the bottom surface of the lens holder is a flat surface for abutting the light-emitting diodes.

Preferably, the lens holder further comprises a plurality of receiving holes recessed from the bottom surface for receiving the light-emitting diodes.

Preferably, one lens hole is a center lens hole located at the center point of the front surface of the lens holder, and the other lens holes are arranged around the center lens hole.

Preferably, each first buckle portion is a protruding buckle portion horizontally protruding from the hole wall of the respective lens hole.

Preferably, each said lens further comprises a tapered arc surface connected between the light entrance surface and the light-emitting surface, and each second buckle portion is a concave buckle portion horizontally recessed from the periphery of the respective tapered arc surface for engagement with one respective protruding buckle portion.

The lampshade module capable of replacing optical projection elements of the present invention can be assembled and applied in front of the light-emitting module of a lamp such as projection lamp, track lamp, garden lamp or wall lamp, so that the light entrance surface of each lens corresponds to one respective light-emitting diode (LED) on the light-emitting module. Through the different arcs of the light entrance surfaces of the lenses, the light projection angle of the lamp is changed. When the manufacture has a specific light projection angle requirement, as long as the lens holder replaces the lenses of the required light projection angle, the lamp of the specific light projection angle can be provided immediately. Moreover, even if the size, shape, structure of the light-emitting module or the position of the light-emitting diodes of the lamp are slightly changed, only a new lens holder needs to be remade, and there is no need to remake the lenses, and the new lens holder can be combined with the existing lenses. Furthermore, the lens holes of the lens holder of the present invention are concave holes for holding the lenses, and rainwater will not penetrate from the lens holes. Therefore, the present invention can easily provide lamps of different light projection angles, allow easy replacement of the lens holder and the lenses, and can reduce manufacturing costs and sales channel inventory pressure, and achieve the effect of waterproof penetration.

DETAILED DESCRIPTION OF THE PREFERRED EMBODIMENTS

Figure 1:
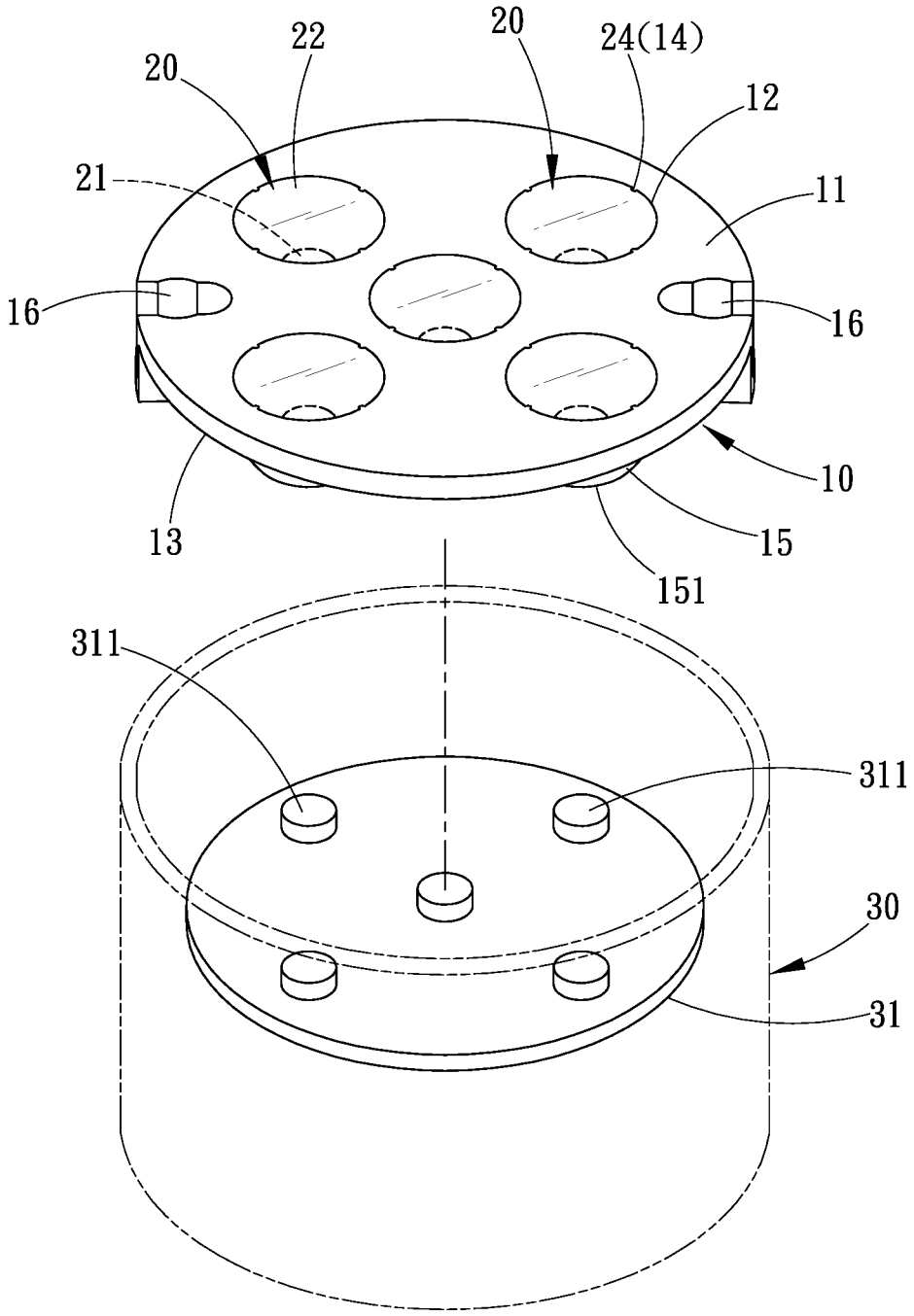
FIG. 1 is a schematic oblique top elevational view of a lampshade module for use with a lamp in accordance with the present invention.
Figure 2:
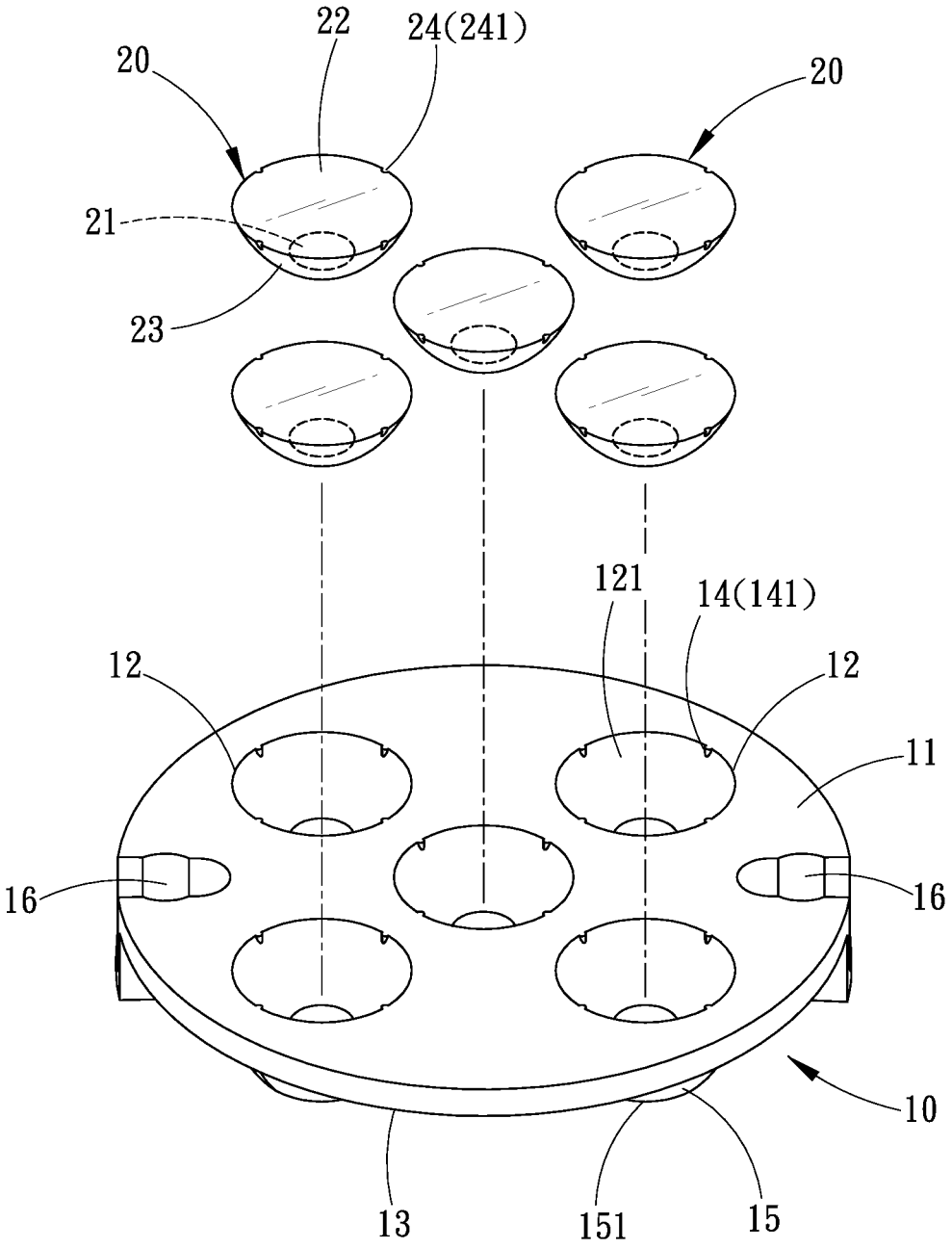
FIG. 2 is an exploded view of the lampshade module.

Referring to FIGS. 1 and 2, a lampshade module capable of replacing optical projection elements in accordance with the present invention is shown. The lampshade module comprises a lens holder 10 and a plurality of lenses 20. It is used in combination with a light-emitting module 31 of a lamp 30, and can adjust the light projection angle of the light-emitting diodes 311 of the light-emitting module 31.

Figure 6:
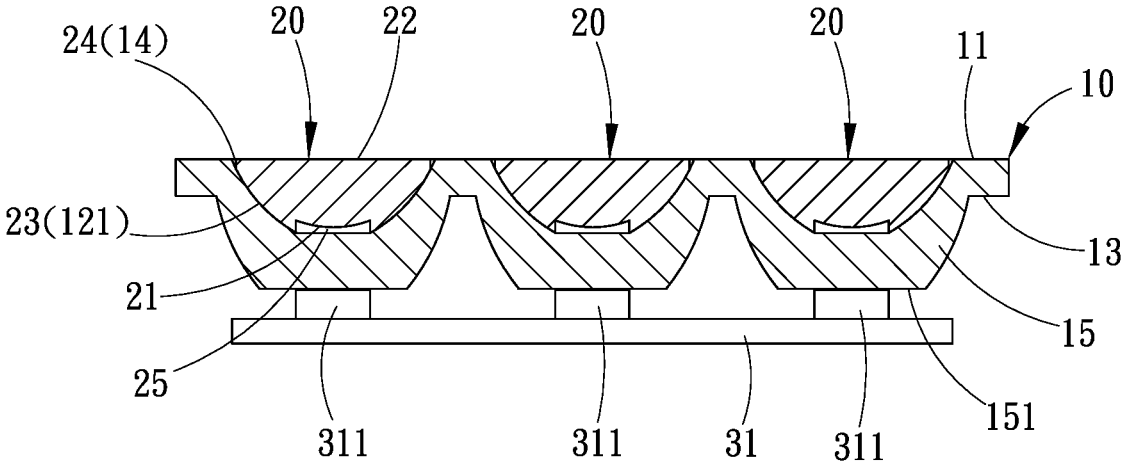
FIG. 6 is a schematic side view illustrating the lens holder of the first embodiment of the present invention combined with a light-emitting module.

Referring to FIG. 6 and FIG. 2 again, the lens holder 10 is made of one-piece plastic molding and used to cover the light-emitting module 31 of the lamp 30. Its outline can be round, square or other shapes, depending on the shape of the lamp 30. The lens holder 10 has a plurality of lens holes 12 located on a front surface 11 thereof. The lens holes 12 are holes that are recessed from the front surface 11 toward an opposing bottom surface 13 of the lens holder 10, so that the back end of each lens hole 12 corresponds to one respective light-emitting diode 311 of the lamp 30. The light of each light-emitting diode 311 passes through the bottom surface 13 of the lens holder 10 and the back end of the corresponding lens hole 12 to enter a respective lens 20. The lens holes 12 are preferably implemented as concave blind holes with an arc-shaped reflective surface 121, so that the lens holes 12 will not penetrate the lens holder 10, so they can also achieve the waterproof function of preventing water from penetrating into the lamp 30. In addition, the hole wall of each lens hole 12 is provided with a plurality of first buckle portions 14, and the first buckle portions 14 are used to buckle the lens 20 inserted into the lens hole 12.

Figure 3:
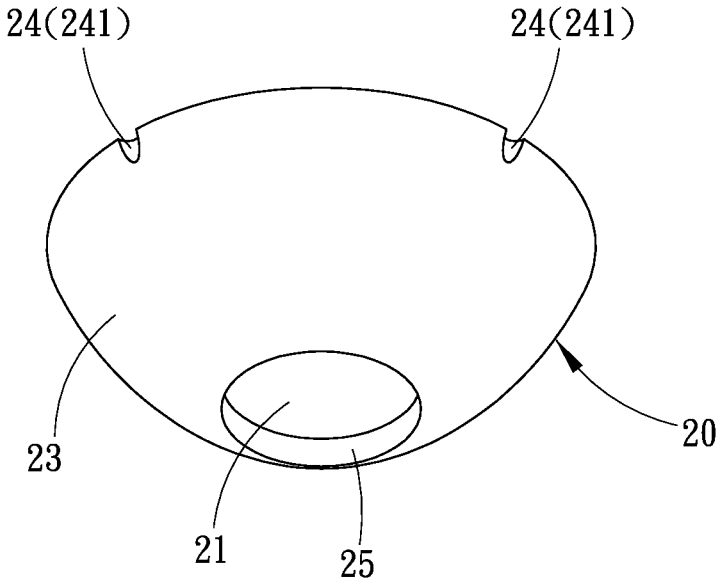
FIG. 3 is an oblique bottom elevational view of the lens.
Figure 4:
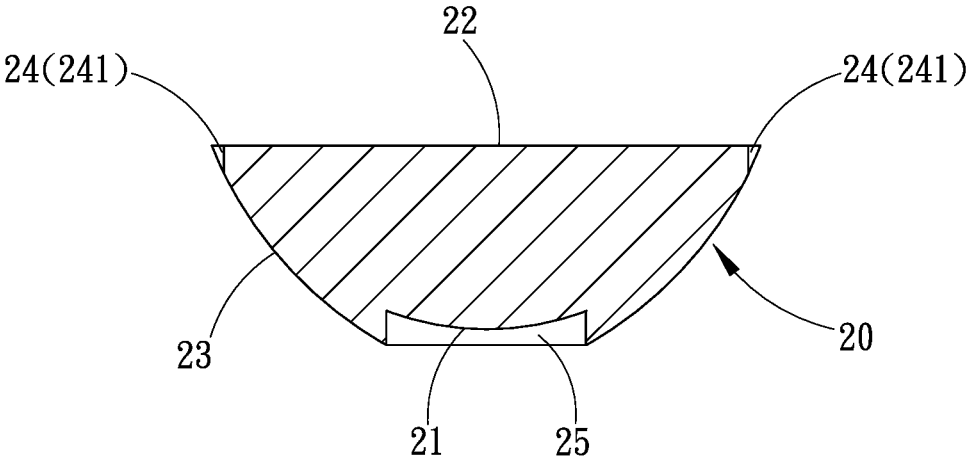
FIG. 4 is a sectional side view of the lens.

Referring to FIG. 3 and FIG. 4, the lenses 20 are to be inserted into the lens holes 12 respectively. The lenses 20 are preferably implemented as light-transmitting lenses, each comprising a light entrance surface 21, a light-emitting surface 22 opposite to the light entrance surface 21, and a tapered arc surface 23 connected between the light entrance surface 21 and the light-emitting surface 22. The light entrance surface 21 is a convex arc surface protruding toward the light-emitting diode 311, and the convex arc surface is used to cause the light of the light-emitting diode 311 to enter and generate a light projection angle. The light-emitting surface 22 is preferably a flat surface, and can also be implemented as a convex arc surface or a concave arc surface as required to cooperate with the light entrance surface 21 to form a variety of light projection angles. In addition, second buckle portions 24 are formed around the tapered arc surface 23 of the lens 20, and the second buckle portions 24 are used for buckling and fixing to the first buckle portions 14 of the respective lens hole 12.

The lampshade module of the present invention can insert lenses 20 of the corresponding angle in the lens holes 12 of the lens holder 10 according to the order of the specific light projection angle ordered by the manufacturer, that is, replace the lens holder 10 with the lenses 12 of the required angle, and then immediately assemble the lamp 30 to provide a lamp with a specific projection angle. In particular, even if the size, shape, light-emitting module structure or light-emitting diode position of the lamp 30 is slightly changed, only a new lens holder 10 needs to be remade, and no other lenses 20 need to be remade. Other styles of lens holder 10 may be combined with existing lenses 20. Therefore, the present invention can easily provide a lamp with a variety of different light projection angles, and can easily replace the lens holder and the lenses, and can reduce the manufacturing cost.

Referring to FIGS. 3 and 4 again, the lens 20 has a groove 25 recessed from a rear end surface opposite to the light-emitting surface 22 and in direction toward the light-emitting surface 22, and the light entrance surface 21 is formed at the bottom of the groove 25. The arcs of the convex arc surfaces formed by the light entrance surfaces 21 of the lenses 20 are different, and they are used to generate different light projection angles. The light projection angles can be any angle between 5° and 120°.

Figure 5:
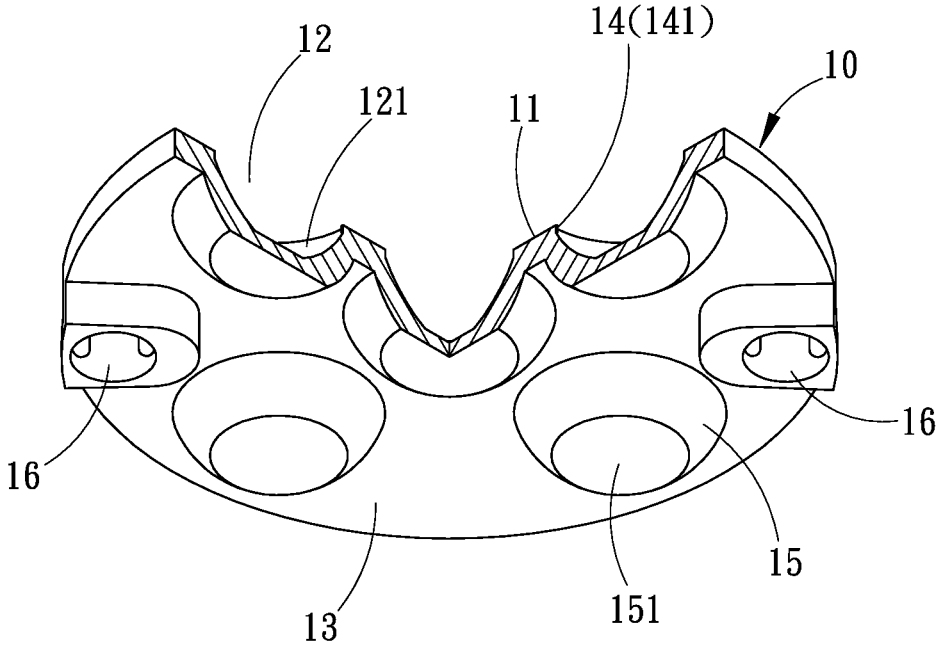
FIG. 5 is a sectional bottom elevation of the lens holder in accordance with the first embodiment of the present invention.
Figure 7:
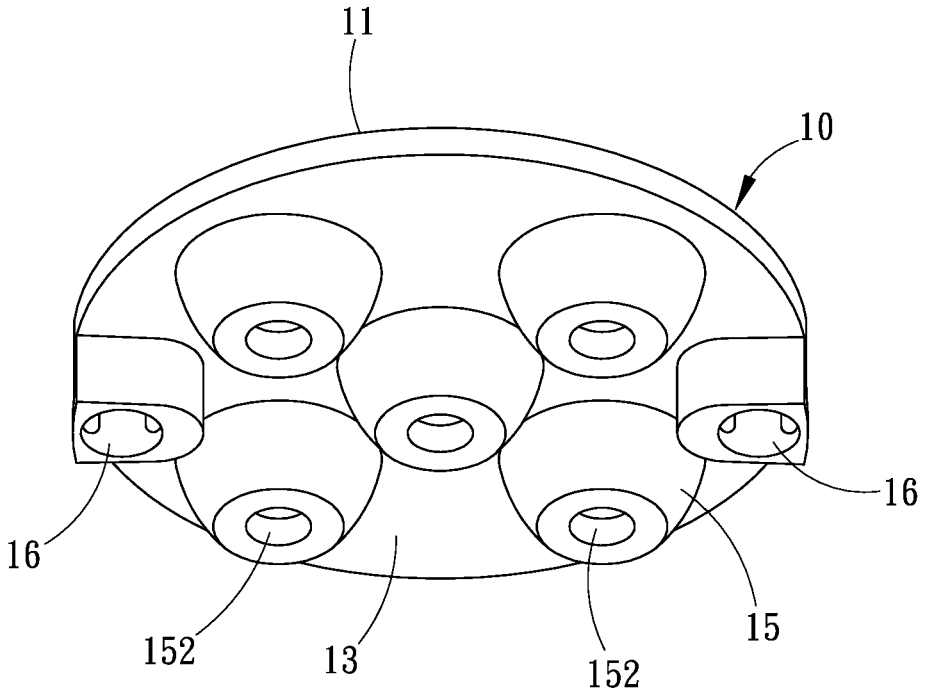
FIG. 7 is a sectional bottom elevation of the lens holder in accordance with the second embodiment of the present invention.
Figure 8:
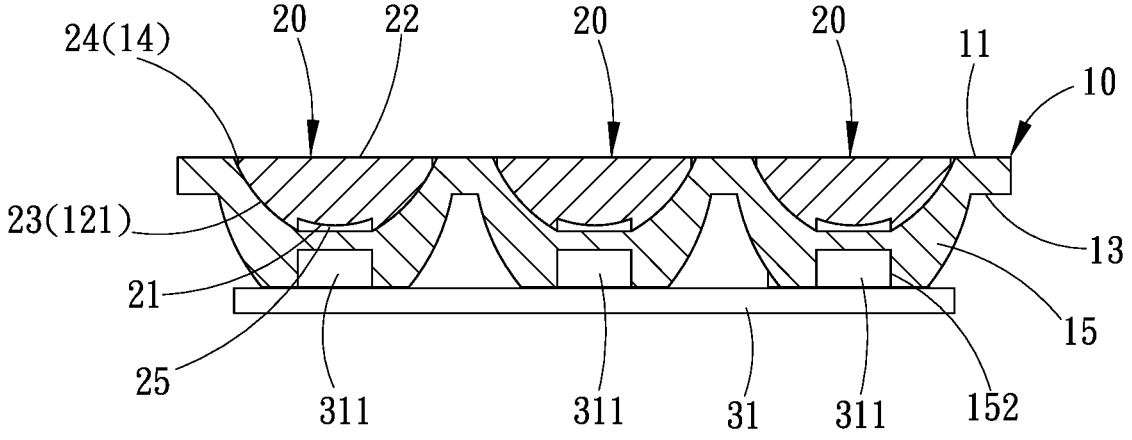
FIG. 8 is a schematic side view illustrating the lens holder of the second embodiment of the present invention combined with a light-emitting module.

Referring to FIGS. 1 and 2 again, the position and arrangement of the plurality of lens holes 12 of the lens holder 10 are basically unlimited. It is better to implement a lens hole 12 formed at the center point of the front surface of the lens holder 10, and a plurality of lens holes 12 around the center point. As shown in FIG. 5 and FIG. 6, the aforementioned lens holder 10 further comprises a plurality of bumps 15 protruding from the bottom surface thereof corresponding to the lens holes 12, so that the lens holes 12 are respectively recessed into the bumps 15, and the bottom end of each bump 15 is a flat surface 151. The flat surface 151 abuts the respective light-emitting diode 311. As shown in FIG. 7 and FIG. 8, the bottom end of the bump 15 may be recessed with a receiving hole 152 corresponding to the associated lens hole 12, and the receiving hole 152 is used to receive the respective light-emitting diode 311. In addition, the lens holder 10 further comprises two screw mounting portions 16 respectively located at two opposite lateral sides thereof, and the screw mounting portions 16 can be of any structure for the passing of screws to be fixed on the lamp 30.

Referring to FIG. 2 again, the above-mentioned first buckle portions 14 of the lens holder 10 may be protruding buckle portions 141 or other latching structure protruding horizontally from the wall of the lens holes 12. The second buckle portions 24 of the lenses 20 are concave buckle portions 241 that are horizontally recessed from the periphery of the respective tapered arc surfaces 23 or other latch structures that match the first buckle portions 14. Thereby, when the lenses 20 are pushed into the lens holes 12 respectively, the concave buckle portions 241 are clamped or tightly fixed to the respective protruding buckle portions 141, preventing the lenses 20 from being detached from the reverse direction, and achieving easy and convenient assembly into the lens holes.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A lampshade module capable of replacing optical projection elements for combining on a lamp to adjust the light projection angle of light-emitting diodes of a light-emitting module of the lamp, the lampshade module comprising:

a lens holder comprising:

a front surface, an opposing bottom surface, a plurality of lens holes recessed from said front surface toward said bottom surface, and at least one first buckle portion located on a hole wall of each said lens hole, wherein each said lens hole is a blind hole having a back end corresponding to one respective said light-emitting diode of said lamp; and a plurality of lenses respectively inserted into said plurality of lens holes of said lens holder, each said lens being a light-transmitting lens and comprising:

a light entrance surface, a light-emitting surface opposite to said light entrance surface, and at least one second buckle portion formed around the periphery thereof, wherein said light entrance surface is a convex arc surface protruding in direction toward one respective said light-emitting diode, said convex arc surface is used to cause the light of the respective said light-emitting diode, after passing through the bottom surface of the lens holder and the back end of the respective said lens hole, to enter the respective said lens and project at a light projection angle, and the at least one second buckle portion is configured for buckling and fixing on said at least one first buckle portion of the respective said lens hole to hold down each lens in the respective said lens hole.

2. The lampshade module as claimed in claim 1, wherein each said lens further comprises a back end opposite to said light-emitting surface and a groove recessed from said back end in direction toward said light-emitting surface, and the associated said light entrance surface is formed at a bottom of said groove.

3. The lampshade module as claimed in claim 2, wherein the arcs of said convex arc surfaces of said lenses are different and adapted for projecting light at different light projection angles.

4. The lampshade module as claimed in claim 3, wherein said different light projection angles are within the range 5°-120°.

5. The lampshade module as claimed in claim 2, wherein the lens holder further comprises a plurality of bumps each protruding from said bottom surface of said lens holder corresponding to a respective said lens hole and having a flat bottom surface for abutting one respective said light-emitting diode.

6. The lampshade module as claimed in claim 5, wherein one said lens hole is a center lens hole located at the center point of said front surface of said lens holder, and the other said lens holes are arranged around said center lens hole.

7. The lampshade module as claimed in claim 2, wherein the lens holder further comprises a plurality of bumps each protruding from said bottom surface of said lens holder corresponding to a respective said lens hole and having a bottom end that is recessed inward to form a blind hole for receiving one respective said light-emitting diode.

8. The lampshade module as claimed in claim 7, wherein one said lens hole is a center lens hole located at the center point of said front surface of said lens holder, and the other said lens holes are arranged around said center lens hole.

9. The lampshade module as claimed in claim 1, wherein the arcs of said convex arc surfaces of said lenses are different and adapted for projecting light at different light projection angles.

10. The lampshade module as claimed in claim 9, wherein said different light projection angles are within the range 5°-120°.

11. The lampshade module as claimed in claim 1, wherein each said first buckle portion is a protruding buckle portion horizontally protruding from the hole wall of the respective said lens hole.

12. The lampshade module as claimed in claim 11, wherein each said lens further comprises a tapered arc surface connected between said light entrance surface and said light-emitting surface, and each said second buckle portion is a concave buckle portion horizontally recessed from the periphery of the respective said tapered arc surface for engagement with one respective said protruding buckle portion.

13. The lampshade module as claimed in claim 1, wherein said lens holder further comprises a screw mounting portion located at one lateral side thereof for the passing of a screw to be fixed on said lamp.

14. A lamp assembly comprising:

a light-emitting module having a plurality of light-emitting diodes disposed thereon;

a lampshade module comprising:

a lens holder comprising:

a front surface;

an opposing bottom surface;

a plurality of lens holes recessed from said front surface toward said bottom surface; and at least one first buckle portion located on a hole wall of each said lens hole, wherein each said lens hole is a blind hole having a back end corresponding to one respective said light-emitting diode; and a plurality of lenses respectively inserted into said plurality of lens holes of said lens holder, each said lens being a light-transmitting lens and comprising:

a light entrance surface;

a light-emitting surface opposite to said light entrance surface; and at least one second buckle portion formed around the periphery thereof, wherein said light entrance surface is a convex arc surface protruding in direction toward one respective said light-emitting diode;

said convex arc surface is used to cause the light of the respective said light-emitting diode, after passing through the bottom surface of the lens holder and the back end of the respective said lens hole, to enter the respective said lens and project at a light projection angle; and the at least one second buckle portion is configured for buckling and fixing on said at least one first buckle portion of the respective said lens hole to hold down each lens in the respective said lens hole.

15. The lamp assembly as claimed in claim 14, wherein each said lens further comprises a back end opposite to said light-emitting surface and a groove recessed from said back end in direction toward said light-emitting surface, and said light entrance surface is formed at a bottom of said groove.

16. The lamp assembly as claimed in claim 15, wherein the lens holder further comprises a plurality of bumps each protruding from said bottom surface of said lens holder corresponding to a respective said lens hole and having a flat bottom surface for abutting one respective said light-emitting diode.

17. The lamp assembly as claimed in claim 15, wherein the lens holder further comprises a plurality of bumps each protruding from said bottom surface of said lens holder corresponding to a respective said lens hole and having a bottom end that is recessed inward to form a blind hole for receiving one respective said light-emitting diode.

18. The lamp assembly as claimed in claim 14, wherein each said first buckle portion is a protruding buckle portion horizontally protruding from the hole wall of the respective said lens hole.

19. The lamp assembly as claimed in claim 18, wherein each said lens further comprises a tapered arc surface connected between said light entrance surface and said light-emitting surface, and each said second buckle portion is a concave buckle portion horizontally recessed from the periphery of the respective said tapered arc surface for engagement with one respective said protruding buckle portion.

* * * * *